US007946035B2

(12) United States Patent
Thompson

(10) Patent No.: US 7,946,035 B2
(45) Date of Patent: May 24, 2011

(54) METHOD OF MANUFACTURING A HOLLOW ARTICLE

(75) Inventor: Ewan F. Thompson, Derby (GB)

(73) Assignee: Rolls-Royce PLC, London (GB)

( * ) Notice: Subject to any disclaimer, the term of this patent is extended or adjusted under 35 U.S.C. 154(b) by 1084 days.

(21) Appl. No.: 11/724,237

(22) Filed: Mar. 15, 2007

(65) Prior Publication Data

US 2007/0286760 A1 Dec. 13, 2007

(30) Foreign Application Priority Data

Apr. 11, 2006 (GB) ..... 0607228.4

(51) Int. Cl.

| | |
|---|---|
| ***B21D 53/78*** | (2006.01) |
| ***B22F 7/00*** | (2006.01) |
| ***B22F 1/02*** | (2006.01) |
| ***B22F 3/15*** | (2006.01) |

(52) U.S. Cl. ..... 29/889.72; 419/8; 419/38; 419/49

(58) Field of Classification Search ..... 29/889.72; 419/8, 38, 49

See application file for complete search history.

(56) References Cited

U.S. PATENT DOCUMENTS

| | | | | |
|---|---|---|---|---|
| 3,623,204 | A * | 11/1971 | Wagle | 228/182 |
| 3,810,286 | A * | 5/1974 | Kaufman, Sr. | 29/889.72 |
| 3,927,817 | A * | 12/1975 | Hamilton et al. | 228/157 |
| 4,043,498 | A | 8/1977 | Conn, Jr. | |
| 4,089,456 | A * | 5/1978 | Toppen et al. | 228/195 |
| 4,595,444 | A * | 6/1986 | Legge et al. | 156/285 |
| 4,620,582 | A * | 11/1986 | Muller-Spath | 164/5 |
| 4,772,450 | A * | 9/1988 | Friedman | 419/49 |
| 5,129,787 | A | 7/1992 | Violette et al. | |
| 5,130,084 | A * | 7/1992 | Matheny et al. | 419/8 |
| 7,407,622 | B2 * | 8/2008 | Voice et al. | 419/5 |
| 2002/0122738 | A1 | 9/2002 | Van Daam et al. | |
| 2004/0200887 | A1 | 10/2004 | Franchet et al. | |

FOREIGN PATENT DOCUMENTS

| | | |
|---|---|---|
| GB | 1 532 026 | 11/1978 |
| GB | 1 557 744 | 12/1979 |
| GB | 1 582 651 | 1/1981 |
| GB | 2 208 389 A | 3/1989 |

* cited by examiner

*Primary Examiner* — David P Bryant
*Assistant Examiner* — Jacob J Cigna
(74) *Attorney, Agent, or Firm* — Oliff & Berridge, PLC

(57) ABSTRACT

A method of manufacturing a hollow article (10) comprising the steps of cold pressing two members (30,34) to form at least one depression (32,36) in the members (30,34). Arranging the two members (30,34) in abutting relationship such that the at least one depression (32,36) defines at least one chamber between the two members (30,34). Sealing (41) the edges (40,42) of the two members (30,34) together to form a core structure (44). Positioning the core structure (44) in a mold (46) to define a cavity (48) between the external surface (50) of the core structure (44) and the internal surface (52) of the mold (46), the internal surface (52) of the mold (46) substantially defining the external shape of the hollow article (10). Filling the cavity (48) between the core structure (44) and the mold (46) with a powder material (54), sealing the open edge of the core structure (44) to the mold (46). Removing gases from the cavity (48) containing the powder material (54), applying heat and pressures to consolidate the power material to form the hollow article (10) in the cavity (46) and removing the mold (46) from the hollow article (10).

24 Claims, 2 Drawing Sheets

METHOD OF MANUFACTURING A HOLLOW ARTICLE

The present invention relates to a method of manufacturing a hollow article and in particular relates to a method of manufacturing a hollow fan blade, or a hollow fan outlet guide vane, or other hollow aerofoil, or a hollow strut of a gas turbine engine using powder metallurgy.

Accordingly the present invention seeks to provide a novel method of manufacturing a hollow article.

Accordingly the present invention provides a method of manufacturing a hollow article comprising the steps of:—

(a) providing two members, (b) pressing at least one of the two members to form at least one depression in the at least one member, (c) arranging the two members in abutting relationship such that the at least one depression defines at least one chamber between the two members, (d) sealing the edges of the two members together except for one open edge to form a core structure, (e) positioning the core structure in an open ended mould to define a cavity between the external surface of the core structure and the internal surface of the mould, the internal surface of the mould substantially defining the external shape of the hollow article, (f) filling the cavity between the core structure and the mould with a powder material, (g) sealing the open edge of the core structure to the open end of the mould, (h) filling the at least one chamber within the core structure with a material to support the core structure, (i) removing gases from the cavity containing the powder material, (j) applying heat and pressures to consolidate the power material to form the hollow article in the cavity, (k) removing the mould from the hollow article.

Preferably the step (b) comprises cold pressing or hot pressing.

Preferably the method comprises a subsequent step of machining or forging the hollow article.

Preferably the method comprises a subsequent step of injecting a vibration damping material into the chamber within the hollow article.

Preferably step (d) comprises welding.

Preferably step (g) comprises welding.

Preferably step (h) comprises supplying a pressurised fluid into the at least one chamber within the core structure. The pressurised fluid may be a gas or a liquid.

Preferably the gas is an inert gas.

Preferably the liquid is a liquid metal under the temperatures and pressures of step (j).

Preferably step (i) comprises hot isostatic pressing.

Preferably step (b) comprises cold pressing both members to form at least one depression in each member.

Step (b) may comprise forming a plurality of depressions in the at least one member.

Preferably the members comprise metal members, more preferably the members comprise titanium members or titanium alloy members.

Preferably the powder material comprises powder metal, more preferably the powder material comprises titanium powder or titanium alloy powder.

Preferably step (e) comprises positioning the core structure in an open-ended two-part mould.

Preferably step (e) comprises clamping the edges of the core structure between the two parts of the mould.

Preferably the hollow article is a strut or an aerofoil. Preferably the aerofoil is a fan blade or a fan outlet guide vane.

The present invention will be more fully described by way of example with reference to the accompanying drawings in which:—

Figure 1:
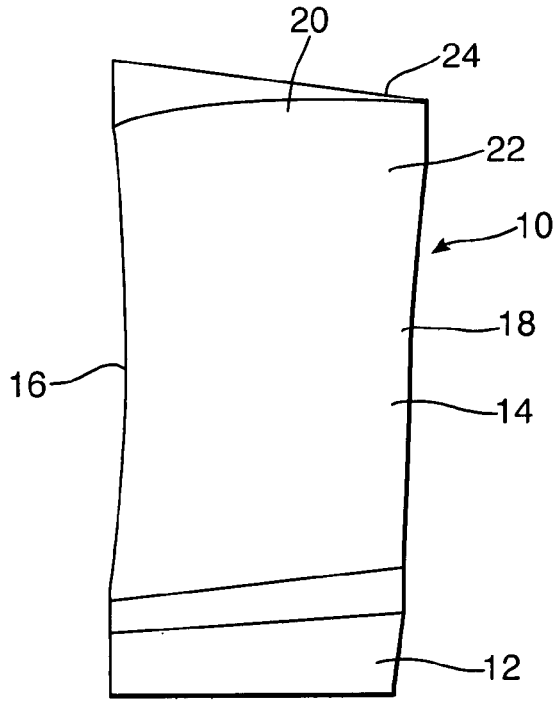
FIG. 1 shows a fan blade for a turbofan gas turbine engine, which has been manufactured according to the present invention.

A hollow fan blade 10, as shown in FIG. 1, comprises a root portion 12 and an aerofoil portion 14. The aerofoil portion 14 comprises a leading edge 16, a trailing edge 18, a tip 20 remote from the root portion 12, a concave pressure surface 22 and a convex suction surface 24.

Figure 2:
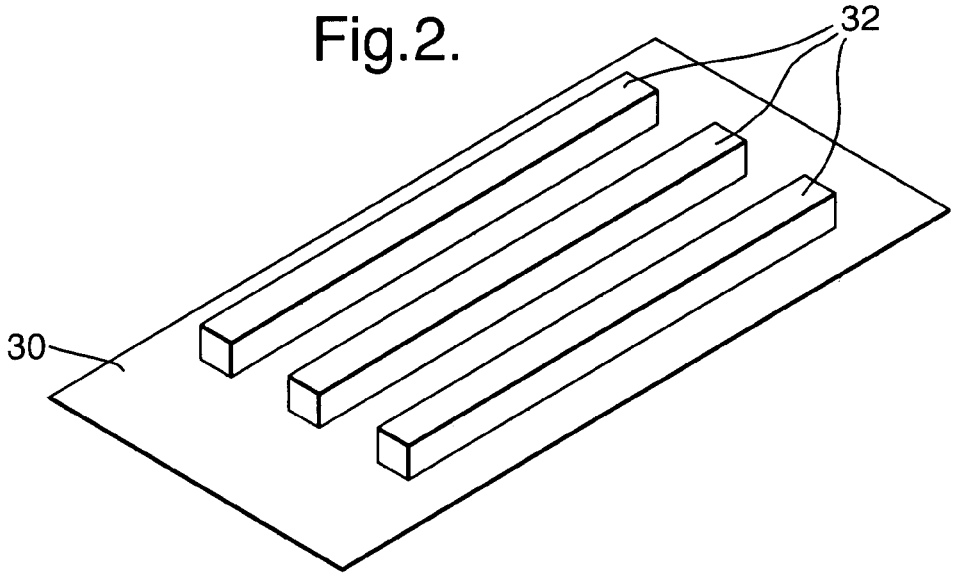
FIG. 2 shows a metal member after a cold pressing step in the method of manufacturing a hollow article according to the present invention.
Figure 3:
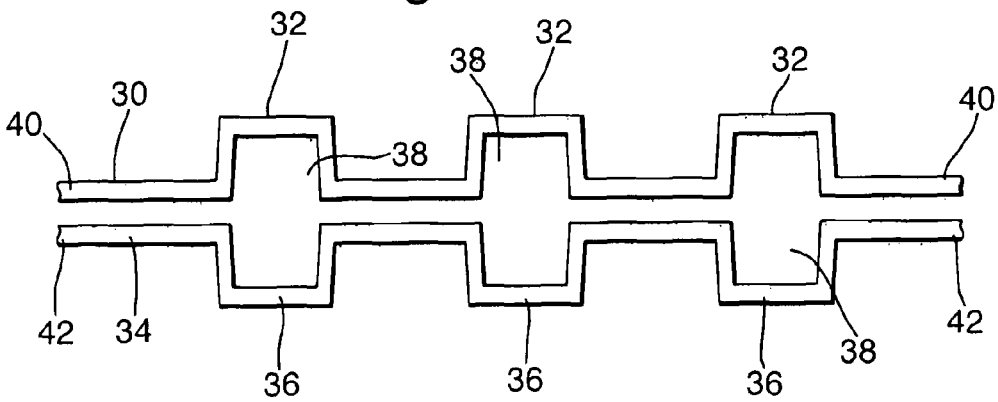
FIG. 3 shows the arrangement of two metal members after an assembling step in the method of manufacturing a hollow article according to the present invention.
Figure 4:
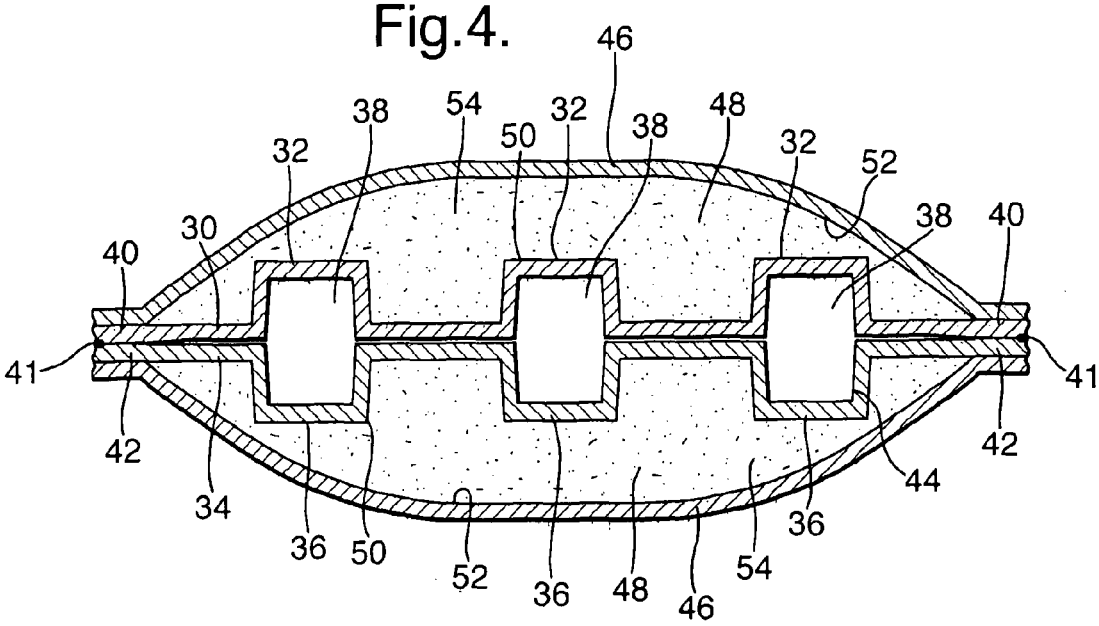
FIG. 4 shows the position of a core structure in a mould after a positioning step in the method of manufacturing a hollow article according to the present invention.

The hollow fan blade 10 is produced using a method described with reference to FIGS. 2 to 4. In a first step of the method two metal members, e.g. metal sheets, 30, 34 are pressed, hot pressed or cold pressed, to define one or more depressions 32, 36 in each of the metal members 30, 34 as shown in FIG. 2. In a second step the two metal members 30 and 34 are arranged in abutting relationship such that each depression 32 in the metal member 30 aligns with a corresponding depression 36 in the metal member 34 to define at least one chamber 38 between the two metal members 30 and 34, as shown in FIG. 3.

In a third step the edge regions 40 and 42 of the two metal members 30 and 34 respectively are sealed together by seals 41 except for one open edge to form a core structure 44. It may also be possible to seal the two metal members 30 and 34 together at other regions where they contact. In a fourth step the core structure 44 is positioned in an open-ended mould 46 to define a cavity 48 between the external surface 50 of the core structure 44 and the internal surface 52 of the mould 46. The internal surface 52 of the mould 46 substantially defines the external shape of the hollow fan blade 10, as shown in FIG. 4. In a fifth step the cavity 48 between the core structure 44 and the mould 46 is filled with a powder metal 54, as also shown in FIG. 4. In a sixth step the open edge of the core structure 44 is sealed to the open end of the mould 46. In a seventh step gases are removed from the cavity 48 containing the powder metal 54, by evacuation of the cavity 48.

In the eighth step heat and pressure is applied externally of the mould 46 to consolidate the powder material 54, to diffusion bond the metal powder 54 together, to form the hollow fan blade 10 in the cavity 48 in the mould 46. The metal powder 54 also diffusion bonds to the metal members 30 and 34. In addition pressure is applied internally of the mould 46 within the chamber, or chambers, 38 to support the metal members 30 and 34 and to maintain the shape of the chamber, or chambers 38.

The application of heat and pressure externally of the mould 46 and the application of pressure internally of the mould 46 within the chamber, or chambers, 38 is by use of a gas, e.g. an inert gas for example argon, or a gas which is non-reactive with the metal members 30 and 34. Alternatively the application of pressure internally of the mould 46 within the chamber, or chambers, 38 may be by use of a liquid, e.g. a liquid metal, which is non-reactive with the metal members 30 and 34 and is a liquid under the temperatures and pressures experienced during the eighth, consolidation step.

Figure 5:
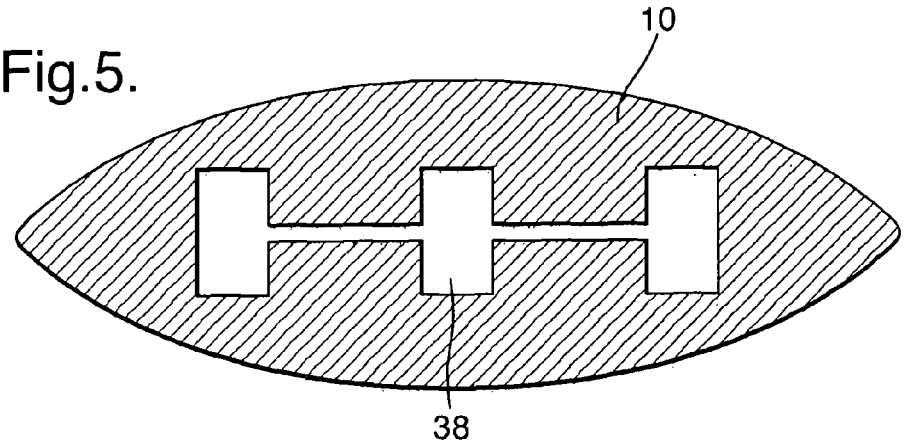
FIG. 5 shows the hollow article after a consolidation step in the method of manufacturing a hollow article according to the present invention.

In a final step the mould 46 is removed from the hollow fan blade 10, as shown in FIG. 5, by machining, dissolving or etching etc. A subsequent step is final machining or forging of the hollow fan blade 10 to final shape.

It may be advantageous, in another subsequent step to inject a vibration damping material into a preselected one or more of the chambers 38 within the hollow fan blade 10. The vibration damping material may be a viscoelastic damping material.

The step of sealing the edge regions 40 and 41 of the metal members 30 and 34 preferably comprises welding, but brazing or other suitable processes may be used as long as the joint is gas tight.

The step of sealing the open edge of the metal members 30 and 34 to the mould 46 preferably comprises welding, but other suitable processes may be used. The step of heating and applying pressure preferably comprises hot isostatic pressing, but other suitable processes may be used.

The step of cold compressing preferably comprises cold pressing both metal members 30 and 34 to form at least one depression 32 and 34 respectively in each metal member 30 and 34. Alternatively it may be possible to form one or more depressions in only one of the metal members 30 or 34.

The metal members 30 and 34 may comprise titanium members or titanium alloy members. The metal powder may comprise titanium powder or titanium alloy powder.

The positioning of the core structure 44 in the mould 46 may comprise positioning the core structure 44 in an open-ended two-part mould.

The edge regions 40 and 42 of the core structure 44 may be clamped between the two parts of the mould 46.

The present invention has a number of advantages, the process is relatively cheap because cold pressing may be used to form the core structure from the metal members. The cold pressing of the metal members is very flexible, allowing metal to be placed exactly at the positions where it is required. Equally well, cavity size, shape and position may be finely controlled to achieve desired stress levels and life of the hollow article. This is particularly useful to allow the vibration damping material to be placed exactly where required. The powder metallurgy allows very efficient material usage to control costs. The process is repeatable, providing consistent quality. The mould halves may be reusable if made from a suitable material, for example by coating with a stop off material such that the powder material does not stick, or bond, to the two parts of the mould.

Although the present invention has been described with reference to the use of a pressure applied internally of the mould within the chamber, or chambers, to support the metal members to maintain the shape of the chamber, or chambers, it is equally possible to fill the cavities with a solid powder, liquid or other incompressible material to support the metal members and then subsequently remove, by melting, dissolving or pouring out, the solid powder, liquid or incompressible material through passages drilled to the chamber, or chambers.

Although the present invention has been described with reference to the metal members being clamped between the two parts of the mould, the metal members may simply rest in the correct position on the two parts of the mould if the metal members are the correct shape. The two parts of the mould may be pre-sealed together by welding, brazing etc before the metal members are placed in the mould or the two parts of the mould may be sealed together by welding, brazing etc after the two parts of the mould have been placed around the metal members.

Although the present invention has been described with reference to the manufacture of a hollow fan blade, it is equally applicable to the manufacture of other hollow articles, for example a hollow strut or other hollow aerofoil, such as a fan outlet guide vane or a compressor blade or a compressor vane.

Although the present invention has been described with reference to the manufacture of a hollow metal article using metal members and metal powder, or metal powders, it is equally possible to manufacture a hollow polymer articles using polymer members and polymer powder, or polymer powders.

I claim:

1. A method of manufacturing a hollow article comprising the steps of:

(a) providing two members, (b) pressing at least one of the two members to form at least one depression in the at least one member, (c) arranging the two members in abutting relationship such that the at least one depression defines at least one chamber between the two members, (d) sealing the edges of the two members together except for one open edge to form a core structure, (e) positioning the core structure in an open ended mould to define a cavity between the external surface of the core structure and the internal surface of the mould, the internal surface of the mould substantially defining the external shape of the hollow article, (f) filling the cavity between the core structure and the mould with a powder material, (g) sealing the open edge of the core structure to the open end of the mould, (h) filling the at least one chamber within the core structure with a material to support the members of the core structure, removing gases from the cavity containing the powder material, (j) applying heat and pressures to consolidate the powder material to form the hollow article in the cavity, (k) removing the mould from the hollow article.

2. A method as claimed in claim 1 wherein the method comprises a subsequent step of machining or forging the hollow article.

3. A method as claimed in claim 1 wherein step (b) comprises cold pressing or hot pressing.

4. A method as claimed in claim 1 wherein step (d) comprises welding.

5. A method as claimed in claim 1 wherein step (g) comprises welding.

6. A method as claimed in claim 1 wherein step (h) comprises supplying a pressurised fluid into the at least one chamber within the core structure.

7. A method as claimed in claim 1 wherein step (i) comprises hot isostatic pressing.

8. A method as claimed in claim 1 wherein step (b) comprises cold pressing both members to form at least one depression in each member.

9. A method as claimed in claim 1 wherein step (b) comprises forming a plurality of depressions in the at least one member.

10. A method as claimed in claim 1 wherein the members comprise metal members.

11. A method as claimed in claim 1 wherein the powder material comprises powder metal.

12. A method as claimed in claim 1 wherein step (e) comprises positioning the core structure in an open ended two-part mould.

13. A method as claimed in claim 1 wherein the hollow article is a strut or an aerofoil.

14. A method as claimed in claim 6 wherein the pressurised fluid is a gas or a liquid.

15. A method as claimed in claim 14 wherein the gas is an inert gas.

16. A method as claimed in claim 14 wherein the liquid is a liquid metal under the temperatures and pressures of step (j).

17. A method as claimed in claim 10 wherein the members comprise titanium members or titanium alloy members.

18. A method as claimed in claim 11 wherein the powder material comprises titanium powder or titanium alloy powder.

19. A method as claimed in claim 12 wherein step (e) comprises clamping the edges of the core structure between the two parts of the mould.

20. A method as claimed in claim 12 wherein step (e) comprises positioning the core structure in a re-usable mould.

21. A method as claimed in claim 13 wherein the aerofoil is a fan blade or a fan outlet guide vane.

22. A method as claimed in claim 13 wherein the method comprises a subsequent step of injecting a vibration damping material into the chamber within the hollow article, the vibration damping material being a viscoelastic damping material.

23. A method as claimed in claim 20 wherein step (e) comprises coating the re-usable mould with a stop off material.

24. A method of manufacturing a hollow article comprising the steps of:

(a) providing two members, (b) pressing at least one of the two members to form at least one depression in the at least one member, (c) arranging the two members in abutting relationship such that the at least one depression defines at least one chamber between the two members, (d) sealing the edges of the two members together except for one open edge to form a core structure, (e) forming an open ended mould, (f) positioning the core structure in the open ended mould to define a cavity between the external surface of the core structure and the internal surface of the mould, the internal surface of the mould substantially defining the external shape of the hollow article, (g) filling the cavity between the core structure and the mould with a powder material, (h) sealing the open edge of the core structure to the open end of the mould, (i) filling the at least one chamber within the core structure with a material to support the metal members of the core structure, (j) removing gases from the cavity containing the powder material, (k) applying heat and pressures to consolidate the powder material to form the hollow article in the cavity, (l) removing the mould from the hollow article, wherein steps (a) to (e) precede step (f) and step (g) immediately follows step (f).

* * * * *